United States Patent [19]

Haboush, II et al.

[11] Patent Number: 5,058,555

[45] Date of Patent: Oct. 22, 1991

[54] MODULAR FUEL INJECTOR POD AND FUEL INJECTION SYSTEM

[75] Inventors: William P. Haboush, II, Pontiac; John G. Schramm, Ann Arbor, both of Mich.

[73] Assignee: Handy & Harman Automotive Group, Inc., Auburn Hills, Mich.

[21] Appl. No.: 513,150

[22] Filed: Apr. 23, 1990

[51] Int. Cl.[5] ..... F02M 55/02

[52] U.S. Cl. ..... 123/470; 123/456; 239/600

[58] Field of Search ..... 123/468, 469, 456, 470, 123/472; 239/585, 600, 550, 551

[56] References Cited

U.S. PATENT DOCUMENTS

| | | | |
|---|---|---|---|
| 3,788,287 | 1/1974 | Falen | 123/470 |
| 3,929,109 | 12/1975 | Chamberlain | 123/32 R |
| 3,930,483 | 1/1976 | Blisko et al. | 123/139 AW |
| 3,941,109 | 3/1976 | Schmid | 123/139 AW |
| 4,206,725 | 6/1980 | Jenkel | 123/470 |
| 4,403,586 | 9/1983 | Taniguchi | 123/468 |
| 4,519,372 | 5/1985 | Hoffman | 123/470 |
| 4,601,275 | 7/1986 | Weinand | 123/456 |
| 4,727,843 | 3/1988 | Petersen et al. | 123/470 |
| 4,776,313 | 10/1988 | Freismuth | 123/468 |
| 4,860,710 | 8/1989 | Hafner | 123/469 |
| 4,913,119 | 4/1990 | Usui | 123/456 |
| 4,915,305 | 4/1990 | O'Brien | 239/550 |

*Primary Examiner*—Carl Stuart Miller

*Attorney, Agent, or Firm*—Pennie & Edmonds

[57] ABSTRACT

A modular fuel injector pod for holding individual fuel injectors in place on an intake manifold, cylinder head or other support surface associated with an induction system of an internal combustion engine, and for supplying fuel to the injectors. The modular fuel injector pod includes a hollow body, generally configured in four portions of successively decreasing inside diameter adapted to hold a fuel injector. Outwardly projecting tubes supply and take away unused fuel to and from the pod. Fuel used by the associated injector is sprayed into the induction chamber through an outlet in one end of the pod. A modular fuel injector assembly utilizes a pod as described above and includes a retaining clip for holding fuel injector in the pod and o-rings for providing fuel tight seals in the assembly. In a fuel injection system according to the invention, modular fuel injector assemblies are linked to a fuel supply and to one another by standard flexible or rigid fuel lines, thereby providing a continuous circuit for fuel flow. Any number of assemblies may be used, corresponding to the number of cylinders of the engine, and additional assemblies may be provided to meet auxillary fuel requirements.

7 Claims, 5 Drawing Sheets

MODULAR FUEL INJECTOR POD AND FUEL INJECTION SYSTEM

BACKGROUND OF THE INVENTION

The present invention relates to fuel injection systems for internal combustion engines, and more particularly to a modular means for securing fuel injectors in place on an intake manifold, cylinder head, or any chamber associated with the induction system of an internal combustion engine and also for providing a continuous supply of fuel to side feed/bottom feed fuel injectors.

In the prior art, the most common means of securing and providing fuel to the fuel injectors of a fuel injection system involved the use of "fuel rails". Fuel rails are rigid members which provide a means of support for a number of injectors and also supply them with fuel by pipe-like passages in the fuel rail. A significant drawback with fuel rails is the fact that each different engine design requires a uniquely designed fuel rail, or, in some cases, two different designs. This requires large inventories to be kept by manufacturers and dealers, with associated costs being very high for manufacture and storage.

U.S. Pat. No. 3,930,483 to Blisko et al. discloses a fuel injection system in which fuel rails are not used, and instead the fuel injectors are secured directly against the intake manifold by clamps. The clamps also function to supply fuel to the injectors. While this system avoids the use of fuel rails, it is specifically designed for use with diesel engines. An additional disadvantage is that the clamps used to secure the individual injectors are complex and require a relatively large number of parts. For these reasons that design is less than satisfactory for use in internal combustion engines with spark ignition systems.

SUMMARY OF THE INVENTION

It is therefore an object of the present invention to provide modular means for holding and supplying fuel to any number of side feed/bottom feed fuel injectors in a fuel injection system for a combustion engine with spark ignition having any number of cylinders.

It is a further object of the invention to provide such modular means for holding and supplying fuel to fuel injectors which is secure, efficient and uses a minimum of parts.

Additionally, it is an object of the present invention to provide a fuel injection system utilizing modular means for holding and supplying fuel to fuel injectors incorporating the above features.

These and other objects are realized according to the present invention by providing a modular fuel injector pod of generally hollow construction adapted to hold within a cylindrical cavity a single fuel injector. The body may be generally divided into four portions, contoured to match the shape of a side feed/bottom feed fuel injector. An inlet and outlet are provided by which fuel enters the cylindrical body and engulfs the fuel injector around its intake portion. The fuel injector uses a limited amount of the fuel and the excess exits the outlet which may be joined to the inlet of a next successive modular injector pod by standard fuel line. The fuel used by the injector is sprayed into the intake manifold, cylinder head, or other chamber associated with the induction system through an outlet opening in one end of the injector pod.

A modular fuel injector assembly according to the present invention comprises a modular fuel injector pod, as described above, containing a side feed/bottom feed fuel injector. A spring wire retaining clip holds the injector in place inside the pod. O-rings are provided around the injector and seal against the pod in two places in order to isolate the void where the fuel engulfs the injector and prevent fuel leakage. An additional o-ring is provided around one end of the pod in order to seal the pod against a support surface associated with the induction system.

In a fuel injection system according to the present invention, a plurality of modular fuel injector assemblies, corresponding to the number of cylinders of the combustion engine, are mounted externally on the support surface associated with the induction system of the engine. One end of the hollow body of each injector pod communicates with the interior of the induction chamber and thereby directs the fuel spray from the associated injector into the chamber. The modular fuel injector assemblies are joined together in a continuous fuel circuit, including a fuel supply means, by standard fuel line and thereby ensure a supply of fuel to the injectors. Each modular fuel injector assembly is secured to the induction chamber support surface by a simple clamp.

BRIEF DESCRIPTION OF THE DRAWINGS

The features and advantages of the invention will be more readily apparent from the following detailed description of the invention illustrated in the drawing figures, wherein.

DETAILED DESCRIPTION OF THE INVENTION

Figure 1:
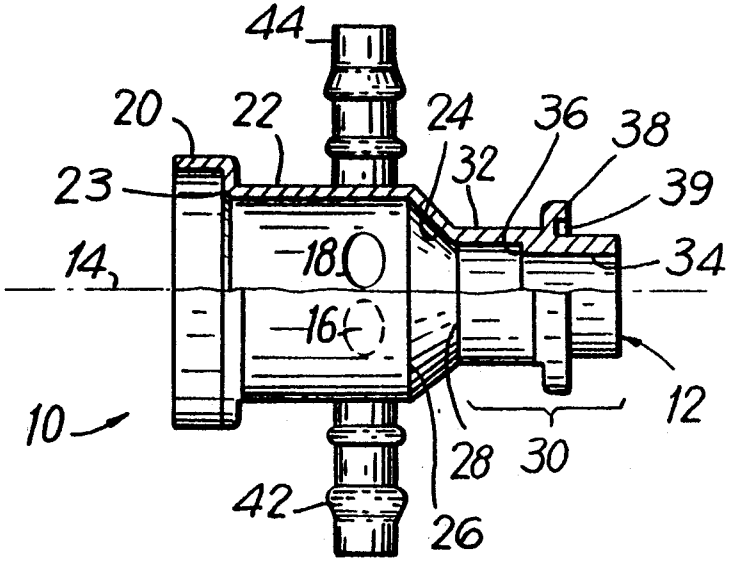
FIG. 1 is a side view of a modular injector pod according to the present invention, shown in partial cross section.
Figure 2:
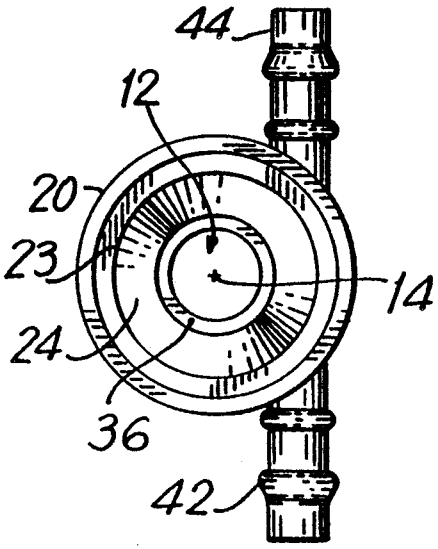
FIG. 2 is a top view of the modular injector pod of FIG. 1.

Referring to the drawing and particularly to FIGS. 1 and 2, the modular injector pod 10 according to the present invention comprises a hollow body having a first outlet or opening 12 at the bottom end and concentric with a central longitudinal axis 14. An inlet 16 and second outlet 18 are provided in the wall of the body. The hollow body defines an internal cylindrical cavity adapted to hold a fuel injector. The exterior shape of the hollow body may be varied depending on the requirements of the system in which it is to be used. The external cylindrical shape illustrated in the drawing figures is used merely by way of example.

The hollow body is generally configured in four portions. A first portion 20 at the top end of the injector pod has the largest inside diameter. A second portion 22 is adjacent the first portion 20 and has a slightly smaller inside diameter than the first portion 20, thereby forming a first internal shoulder 23. Inlet 16 and second outlet 18 are located in the wall of the second portion 22. A third portion 24 is internally frustoconical in shape with its base 26 adjacent the second portion 22 and corresponding in diameter to the second portion 22. The upper end 28 of the frustoconical portion 24 is adjacent a fourth portion 30, which fourth portion 30 includes the first outlet 12 at the bottom end.

The fourth portion 30 of the modular injector pod 10 is formed generally in two parts. A first part 32 has an inside diameter which matches the upper end 28 of the frustoconical portion 24. A second part of the fourth portion 30 has a reduced inside diameter 34 relative to the first part 32, thereby forming second internal shoulder 36. An external shoulder 38 is formed on the outside of the fourth portion 30. An annular groove 39 is provided in the external shoulder 38 for retaining an o-ring. Below the external shoulder 38, the outside of the fourth portion 30 is shaped to be received in an associated opening to the induction chamber of the engine.

Projecting outward from the second portion 22 are tubes 42 and 44 which communicate with the inlet 16 and second outlet 18, respectively. In a preferred embodiment of the present invention tubes 42 and 44 are disposed in-line with respect two each other, and perpendicular to and off-set with respect to the central longitudinal axis 14.

Figure 3:
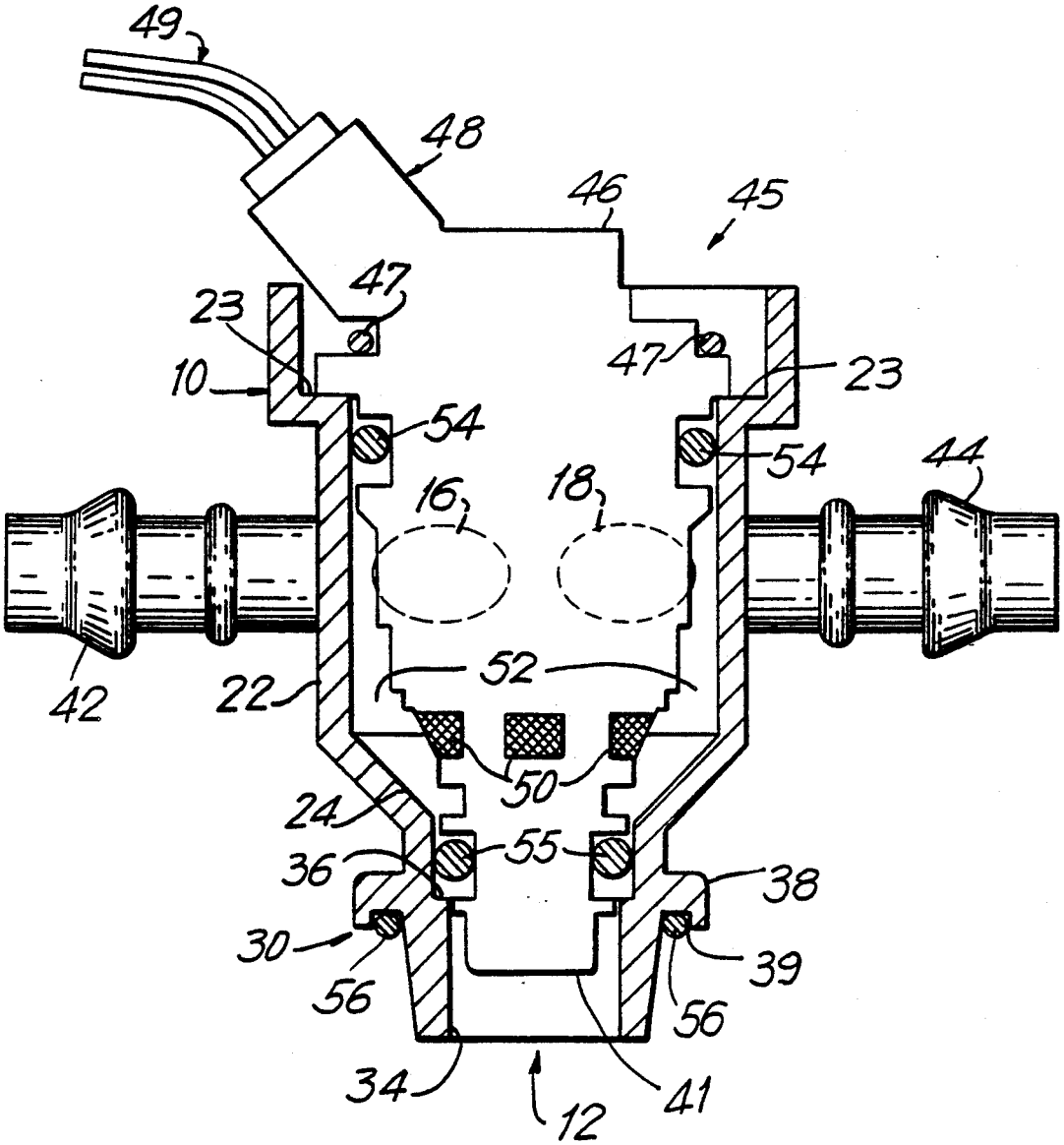
FIG. 3 is a cross sectional view through a modular fuel injector assembly according to the present invention, with the fuel injector illustrated diagrammatically.
Figure 4:
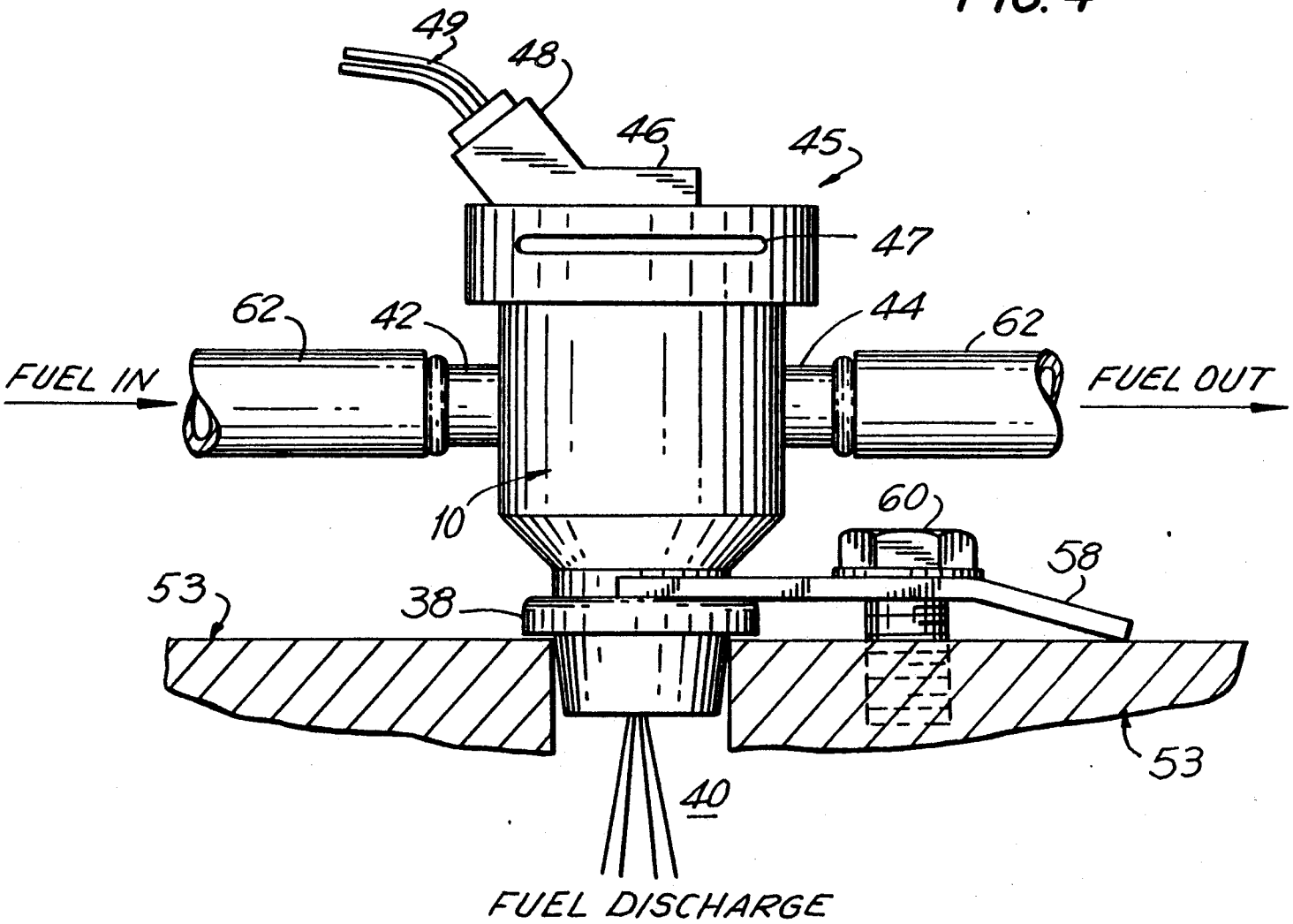
FIG. 4 is a side elevational view of a modular fuel injector assembly in place on an intake manifold of a combustion engine.

Referring to FIGS. 3 and 4, the assembly and operation of a modular fuel injector assembly 45 according to the present invention may be explained in greater detail. A fuel injector 46 is placed in the modular injector pod 10 with the injector nozzle 41 directed toward the first outlet 12. The injector 46 is held securely in place by a spring wire retaining clip 47 which is inserted through small holes in the first portion 20 of the pod 10. Receptacle 48 is the connection for electrical harness 49 which provides electrical power to the injector 46.

The fuel injector 46 narrows in the area of intake ports 50, thereby creating a void 52 which surrounds the injector 46 over part of the second portion 22 and the frustoconical portion 24 of the pod 10. Fuel from the inlet 16 fills the void 52 and engulfs the injector 46 in the region of the intake ports 50. The injector 46 takes a portion of the fuel and sprays it from the nozzle 41 into the induction chamber 40 through first outlet 12. The unused fuel exits the second outlet 18 and from there supplies the next successive modular fuel injector assembly 45.

The first internal shoulder 23 and the inside of the second part 34 of fourth portion 30 provide abutment surfaces against which the injector 46 abuts to minimize movement or vibration of the injector 46. O-rings 54 and 55 isolate the void 52 and prevent fuel leakage. O-ring 56 provides a seal around the opening in the support surface 53 which receives the injector pod 46.

As shown in FIG. 4, a modular injector assembly 45 is placed in an associated opening in the support surface 53 with the first outlet 12 opening into the interior of the induction chamber 40. External shoulder 38 abuts against the support surface 53 and a clamp 58, held in place by threaded fastener 60, secures the assembly 45 in place.

Figure 5:
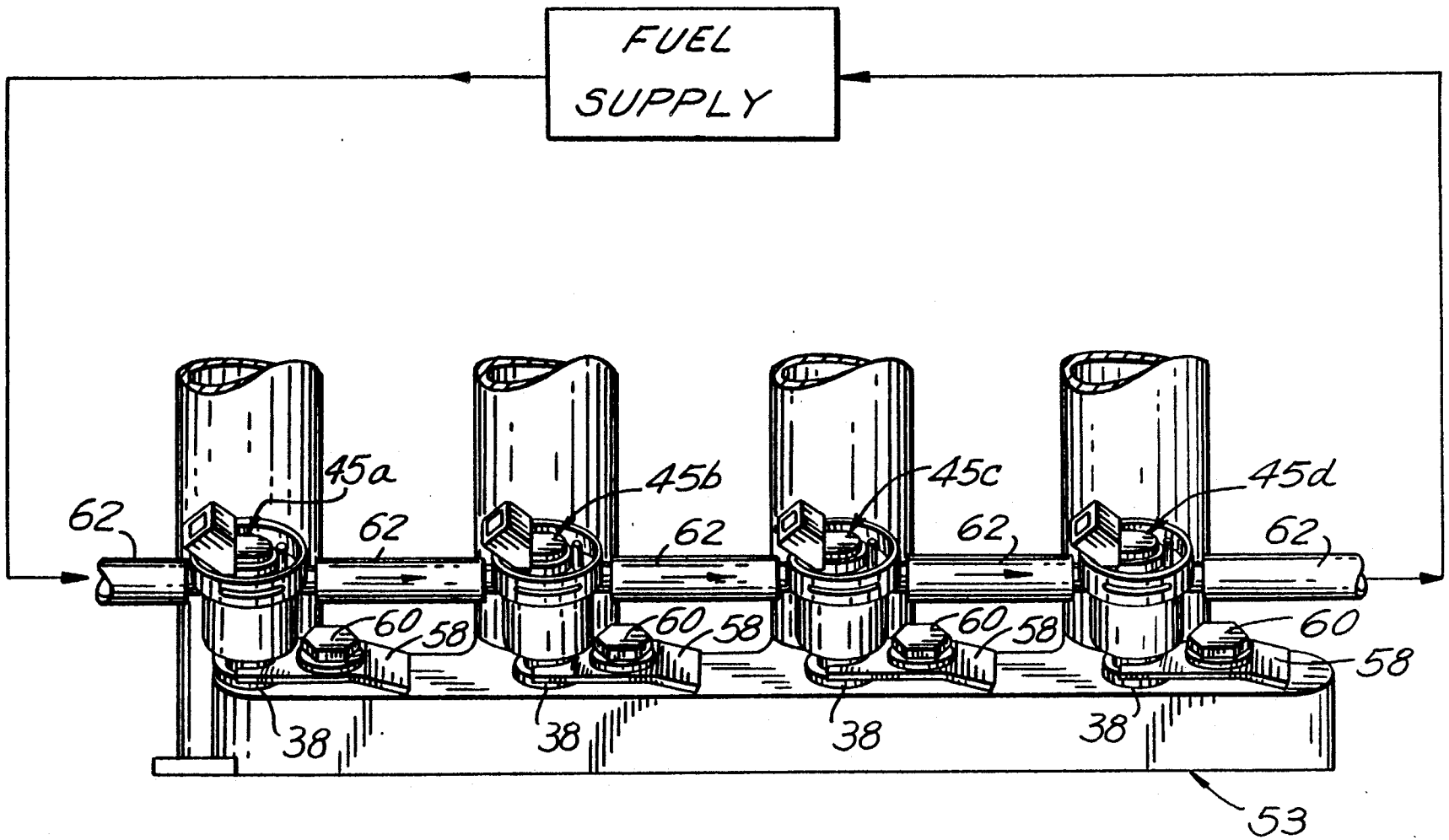
FIG. 5 is a perspective view of a fuel injection system for a combustion engine according to the present invention, with a fuel supply shown in schematic form.

Referring now to FIG. 5, a fuel injection system according to the present invention may be explained in greater detail. FIG. 5 illustrates, by way of example only, a fuel injection system on an intake manifold of an internal combustion engine. It will be apparent to those skilled in the art, based on the above description, that the present invention is equally applicable to use with any chamber associated with the induction system. For this reason, reference numeral 53, used above to designate a support surface associated with an induction chamber generally, refers to the intake manifold shown in FIG. 5. A fuel supply, such as a reservoir, fuel pump and regulator, provides a regulated supply of fuel to the system. Fuel from the fuel supply enters the first modular fuel injector assembly 45*a*. Standard, commercially available fuel line 62 may be used for this purpose, with flexible fuel line being preferred. Fuel enters each respective assembly 45*a–d* from fuel lines 62 which communicate with tube 42, which in turn communicates with inlet 16, as shown in FIG. 3. Unused fuel from the first assembly 45*a* flows to the second assembly 45*b*, and likewise for the remaining assemblies 45*c–d* in the system.

The individual injectors 46 provide fuel spray to the intake manifold 53 as described above with reference to FIGS. 3 and 4. Unused fuel exits each assembly 45*a–d* through second outlet 18 in the pod 10. The fuel then flows to the next successive modular fuel injector assembly through a path defined, in order, by tube 44, fuel line 62, tube 42 and inlet 16. The operation repeats as described above until fuel passes the last assembly. From there the fuel is returned to the fuel supply.

FIG. 5 illustrates a fuel injection system for a combustion engine having four cylinders and four associated modular fuel injector assemblies. It will be readily appreciated by those skilled in the art that additional cylinders and therefore additional assemblies may be added without departing from the teachings of the present invention. This is in fact an object of the invention. For example, such additional cylinders could be added in-line in the configuration shown, or a second group of cylinders and associated modular fuel injector assemblies could communicate with the fuel supply by use of standard fuel couplings.

Figure 6:
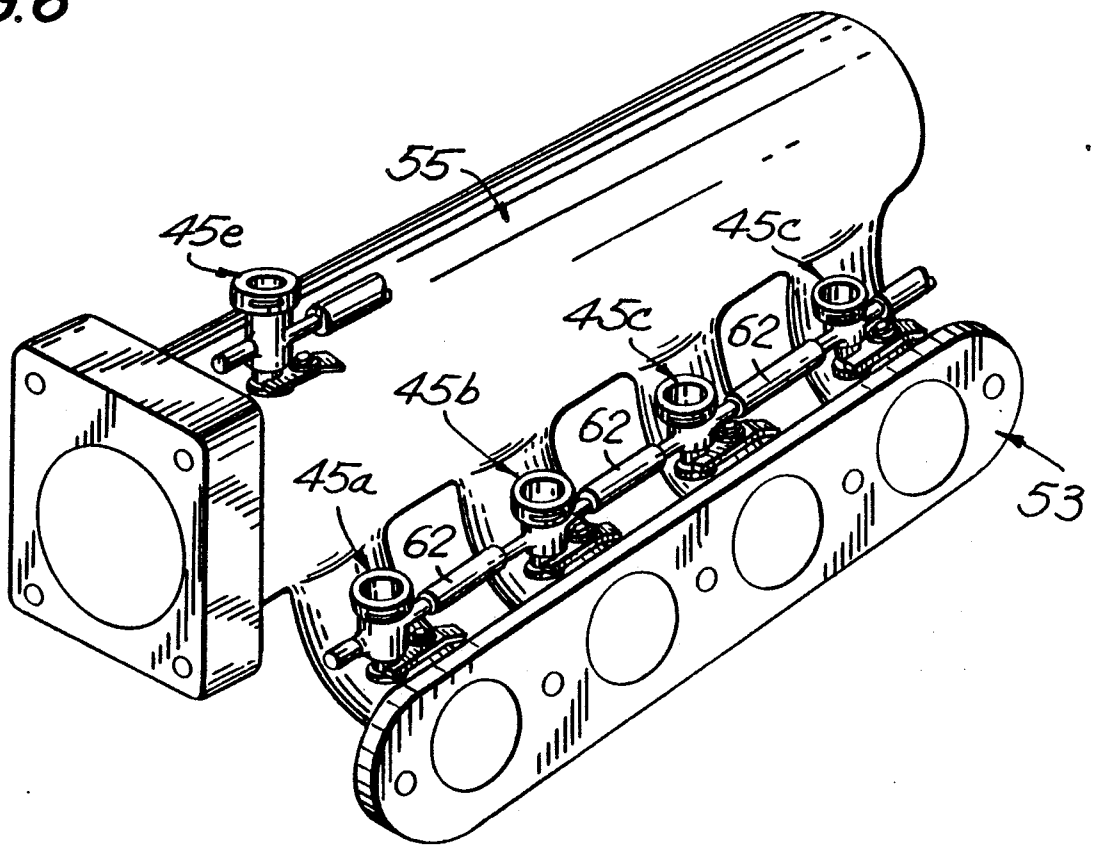
FIG. 6 is a perspective view of a fuel injection system according to the present invention, including a modular fuel injector assembly on the plenum of the intake manifold.

FIG. 6 illustrates a further embodiment of the invention, in which at least one auxiliary modular fuel injector assembly 45*e* is provided on the plenum 55, upstream from the primary injector assemblies 45*a–d* to provide a means for assisting engine start up in cold weather conditions or fulfilling any other auxiliary fuel requirements. The operation of the auxillary injector assembly 45*e* is the same as discussed above with respect to the injector assemblies in general. In this case the interior of the plenum 55 acts as the induction chamber associated with the auxillary injector 45*e*.

It should be apparent that the examples set forth above are merely illustrative and are in no way intended to limit the scope of the invention which is set forth in the appended claims.

What is claimed is:

1. A modular fuel injection system for combustion engines comprising:

a support surface associated with a plurality of induction chambers;

a plurality of modular fuel injector assemblies mounted on said support surface, each assembly being associated with an induction chamber and comprising a hollow body having a central longitudinal axis and an outside wall, said hollow body adapted to contain a fuel injector and define a void between said wall and the fuel injector, said hollow body further defining a first outlet at one end concentric with the hollow body and communicating with an associated induction chamber, said hollow body further having:

a first internal cylindrical portion positioned along the longitudinal axis;

a second internal cylindrical portion adjacent said first portion, having a reduced inside diameter relative to said first portion with a first internal shoulder formed thereby, and said second portion having an inlet and a second outlet disposed therein;

a third internal frustoconical portion adjacent said second portion having a base and an upper end, with the base diameter matching the diameter of said second portion; and a fourth inter cylindrical portion adjacent said frustoconical portion, having an inside diameter matching the upper end diameter of the frustoconical portion and provided with a raised external shoulder on the outside wall;

a fuel injector placed inside said modular injector pod and abutting against said pod at least at one point, said injector having an injector nozzle aligned to spray through said first outlet;

retaining means for retaining the fuel injector in the modular injector pod;

means for sealing the void defined between the fuel injector and modular injector pod to prevent fuel leakage;

means for sealing the modular injector pod against said support surface having an aperture to receive therein said injector pod first outlet;

a plurality of individual fuel lines communicating with the inlets and second outlets of each respective modular fuel injector pod of each of said assemblies; and a fuel supply communicating with said fuel lines, thereby providing continuous regulated supply of fuel to each respective fuel injector.

2. A modular fuel injector assembly, comprising:

a modular fuel injector pod having a hollow body defining an internal cylindrical cavity with a central longitudinal axis and an outside wall defining a first outlet at one end concentric with the cylindrical cavity, said hollow body comprising:

a first internal cylindrical portion positioned along the longitudinal axis, a second internal cylindrical portion adjacent said first portion and having a reduced inside diameter relative to said first portion with an internal shoulder formed thereby, said outside wall in said second portion defining an inlet and a second outlet therein, a third internal frustoconical portion adjacent said second portion having a base and an upper end, with the base diameter matching the inside diameter of the second tubular portion, a fourth internal cylindrical portion adjacent said third portion comprising a first part and a second part, said first part being adjacent the upper end of said frustoconical portion and having an inside diameter matching the inside diameter of the upper end of said frustoconical portion, and said second part being adjacent said first part, said second part having an inside diameter smaller than the first part, the outside wall in said second part forming an external shoulder to abut against a support surface associated with an induction chamber having an aperture to receive therein said injector pod first outlet, and the outside wall below said external shoulder being complementary to said aperture, and two outwardly and oppositely projecting in-line tubes disposed on said second portion, one communicating with the inlet and the other communicating with the second outlet, said tubes projecting perpendicular and offset with respect to the central longitudinal axis;

a side feed/bottom feed fuel injector placed inside said modular injector pod and abutting against said pod along the first internal shoulder and inside said forth portion, said injector having an injector nozzle aligned to spray through said first outlet;

a retaining clip secured to the hollow body in said first portion of the modular injector pod and engaging the fuel injector, thereby retaining the fuel injector in the modular injector pod;

a first o-ring surrounding the fuel injector in the area of said second portion of the modular injector pod and engaging the outside wall of said pod, providing a fuel tight seal between the fuel injector and the modular injector pod;

a second o-ring surrounding the fuel injector in the area of said fourth portion of the modular injector pod and engaging the outside wall of said pod, providing a fuel tight seal between the fuel injector and the modular injector pod; and a third o-ring disposed in an annular groove in the external shoulder provided on said fourth portion of the modular injector pod, thereby providing a seal between said pod and said support surface on which said assembly is placed.

3. The fuel injector system according to claim 1, wherein:

the retaining means comprises a retaining clip inserted through a plurality of apertures defined by the outside wall in said first portion of the modular injector pod; and the fuel injector abuts against the first internal shoulder and the inside of said fourth portion.

4. The fuel injector system according to claim 1, wherein the means for sealing the void comprises:

a first o-ring surrounding the fuel injector in the area of said second portion of the modular injector pod and engaging the outside wall of said pod; and a second o-ring surrounding the fuel injector in the area of said fourth portion of the modular injector pod and engaging the outside wall of said pod, thereby providing a fuel tight seal around said void between the fuel injector and the modular injector pod.

5. The fuel injector system according to claim 1, wherein the means for sealing the modular injector pod against a support surface comprises an o-ring disposed in an annular groove formed in the external shoulder of said fourth portion of the modular injector pod.

6. The fuel injection system according to claim 1, wherein the means for retaining each of said assemblies against the intake manifold comprises:

a rectangular clamp having U-shaped slot engaging the outside wall of the modular fuel injector pod in said fourth portion above said external shoulder, said clamp further defining a hole therethrough opposite said slot; and a threaded fastener inserted through said hole in said clamp and engaging a complimentarily threaded hole in the support surface.

7. The fuel injection system according to claim 1, wherein the support surface and induction chamber are selected from a group of engine components consisting of intake manifolds, cylinder heads and plenums.

* * * * *